US010047746B2

(12) United States Patent
Koyama et al.

(10) Patent No.: US 10,047,746 B2
(45) Date of Patent: Aug. 14, 2018

(54) REFRIGERANT COMPRESSOR AND REFRIGERATION CYCLE DEVICE

(75) Inventors: Masaki Koyama, Tokyo (JP); Keiji Sasao, Tokyo (JP)

(73) Assignee: Hitachi-Johnston Controls Air Conditioning, Inc., Tokyo (JP)

( * ) Notice: Subject to any disclaimer, the term of this patent is extended or adjusted under 35 U.S.C. 154(b) by 473 days.

(21) Appl. No.: 14/402,965

(22) PCT Filed: May 22, 2012

(86) PCT No.: PCT/JP2012/063013

§ 371 (c)(1),
(2), (4) Date: Nov. 21, 2014

(87) PCT Pub. No.: WO2013/175566

PCT Pub. Date: Nov. 28, 2013

(65) Prior Publication Data

US 2015/0159649 A1 Jun. 11, 2015

(51) Int. Cl.
*F04C 29/04* (2006.01)
*F04C 15/00* (2006.01)
(Continued)

(52) U.S. Cl.
CPC ..... *F04C 15/0096* (2013.01); *F04B 39/04* (2013.01); *F04B 39/06* (2013.01);
(Continued)

(58) Field of Classification Search
CPC .. F04C 15/0096; F04C 15/0057; F04C 15/06; F04C 29/026; F04C 29/045; F04C 29/12; F04C 2/025; F04C 23/008; F04C 18/0215; F04C 18/30; F04B 39/04; F04B 39/06; F04D 29/082; F04D 29/5806
USPC ..... 417/366; 310/156.47, 273; 62/470
See application file for complete search history.

(56) References Cited

U.S. PATENT DOCUMENTS 1,597,666 A * 8/1926 Barr ..... H02K 15/0012 310/211
6,637,216 B1 10/2003 Narney, II
(Continued)

FOREIGN PATENT DOCUMENTS

EP 2541066 A1 * 1/2013 ..... F04C 18/0215
JP 43-10445 Y1 5/1968
(Continued)

OTHER PUBLICATIONS

Extended European Search Report issued in counterpart European Application No. 12877576.4 dated Feb. 2, 2016 (six (6) pages).
(Continued)

*Primary Examiner* — Dominick L Plakkoottam
*Assistant Examiner* — Chirag Jariwala
(74) *Attorney, Agent, or Firm* — Crowell & Moring LLP

(57) ABSTRACT

A refrigerant compressor (100) includes: a sealed vessel (103); a compression mechanism (101) that sucks refrigerant, sucked in the sealed vessel (103), for compression; a motor (102) that drives the compression mechanism (101); a suction pipe (104) for sucking the refrigerant into the sealed vessel (103) when sucking the refrigerant; a cover (117*a*) arranged to face an outlet of the suction pipe (104), to force the refrigerant sucked through the suction pipe (104) to collide against the cover for gas-liquid separation, and to allow liquid refrigerant from the separation to drop on a coil (126) of the motor (102); and a suction passage (118) that introduces gas refrigerant from the gas-liquid separation, for which the refrigerant sucked through the suction pipe is forced to collide against the cover (117*a*), to an inlet of the compression chamber provided in the compression mechanism (101). Thus, a decrease in density of the refrigerant to be compressed, sucked into the sealed vessel (103), can be prevented to prevent a decrease in refrigeration capacity, and the temperature of the motor (102) can be lowered to improve a motor efficiency.

5 Claims, 5 Drawing Sheets

(51) Int. Cl.

| | |
|---|---|
| ***F04B 39/04*** | (2006.01) |
| ***F04B 39/06*** | (2006.01) |
| ***F04C 23/00*** | (2006.01) |
| ***F04C 2/02*** | (2006.01) |
| ***F04C 15/06*** | (2006.01) |
| ***F04C 29/02*** | (2006.01) |
| *F04C 29/12* | (2006.01) |
| *F04C 18/30* | (2006.01) |
| *F04C 18/02* | (2006.01) |

(52) U.S. Cl.

CPC ..... *F04C 2/025* (2013.01); *F04C 15/06* (2013.01); *F04C 23/008* (2013.01); *F04C 29/026* (2013.01); *F04C 29/045* (2013.01); *F04C 18/0215* (2013.01); *F04C 18/30* (2013.01); *F04C 29/12* (2013.01)

(56) References Cited

U.S. PATENT DOCUMENTS 7,137,273 B2 * 11/2006 Ozaki ..... B64D 13/06 62/470

2012/0091850 A1 * 4/2012 Sawahata ..... H02K 17/165 310/211

FOREIGN PATENT DOCUMENTS

| | | | | |
|---|---|---|---|---|
| JP | S-4310445 | | * | 5/1968 |
| JP | 50-137607 | U | | 11/1975 |
| JP | 52-151410 | U | | 11/1977 |
| JP | 55-17601 | A | | 2/1980 |
| JP | 63-50695 | A | | 3/1988 |
| JP | S-6350695 | | * | 3/1988 |
| JP | 9-236092 | A | | 9/1997 |
| JP | 2000175380 | | * | 6/2000 |
| JP | 2001-339929 | A | | 12/2001 |
| JP | 2008-88975 | A | | 4/2008 |

OTHER PUBLICATIONS

International Search Report dated Aug. 21, 2012 with English translation (eight (8) pages).

Japanese-language Written Opinion dated Aug. 21, 2012 (five (5) pages).

* cited by examiner

REFRIGERANT COMPRESSOR AND REFRIGERATION CYCLE DEVICE

TECHNICAL FIELD

The present invention relates to a refrigerant compressor and a refrigeration cycle device, in particular, to a refrigerant compressor and a refrigeration cycle device of low-pressure chamber system having a compression mechanism that, after refrigerant is sucked into a sealed vessel, sucks the refrigerant from the sealed vessel for compression.

BACKGROUND ART

As a refrigerant compressor that houses a compression mechanism for compressing refrigerant and a motor for driving the compression mechanism in a sealed vessel, there is a refrigerant compressor of high-pressure chamber system in which a pressure in the sealed vessel serves as a discharge pressure for refrigerant. However, in the refrigerant compressor of high-pressure chamber system, since a temperature and a pressure becomes high in the sealed vessel, there is a problem that a coil temperature of a motor increases to degrade motor efficiency of the motor, such as a motor using a general ferrite magnet.

On the other hand, there is a refrigerant compressor of low-pressure chamber system in which a pressure in the sealed vessel serves as a suction pressure for the refrigerant. In the refrigerant compressor of low-pressure chamber system, a motor can be cooled with sucked refrigerant having a low temperature and a low pressure. However, since cooling the motor by the refrigerant sucked into the sealed vessel causes density of the refrigerant (gas) to be decreased, there is a problem that circulation amount of the refrigerant circulating in the refrigeration cycle is reduced to lower the refrigeration capacity, and further to lower the efficiency of the refrigeration cycle too. Therefore, in the refrigerant compressor of low-pressure chamber system, a structure is employed that introduces the sucked refrigerant to a compression mechanism without receiving a thermal influence from the motor.

For example, in Japanese Patent Application Publication No. S63-50695, there is a description as "according to the present invention, the inside of a closed casing 1 is partitioned by a compressor part 5, a suction pipe 20 is provided in the closed casing 1 in the part facing a motor part 2 side of an axial through-hole 16 in a shaft 15 coupling a roller 6 in the compressor part 5 with a rotor 4 in the motor part 2, and a suction hole 19 is provided for introducing suction gas into the compressor part 5 through the through-hole 16, to introduce suction gas into the compressor part 5 side without contacting heat from the motor part 2 for the gas to be subject to gas-liquid separation then to be sucked into a cylinder chamber through the suction hole 19." (see page 2, lower right column, lines 5-14).

In addition, in Japanese Patent Application Publication No. H09-236092, there is a description as "an gist of the second invention is to provide a hermetic compressor, for use in a refrigeration apparatus, that allows refrigerant gas to be sucked into a sealed housing, which incorporates a compression mechanism and its driving motor, for the compression mechanism to suck it, and includes a liquid injection circuit for injecting a part of the liquid refrigerant into a compression chamber of the compression mechanism, which is characterized in that a suction pipe of the refrigerant gas is connected to the sealed housing at a position where the refrigerant gas is directly introduced to the compression mechanism, and the liquid injection circuit is branched to connect one of them to a position where the liquid refrigerant is injected toward the motor (see paragraph 0015).

SUMMARY OF THE INVENTION

Problems to be Solved

However, in the compressor described in Japanese Patent Application Publication No. S63-50695, the sucked refrigerant in the closed casing 1 can avoid receiving the thermal influence from the motor, while the motor is not cooled to have a high temperature. Therefore, there is a problem in the motor, such as a motor using a ferrite magnet, which has a characteristic that the motor efficiency decreases as the operating temperature is raised. In addition, the compressor described in Japanese Patent Application Publication No. S63-50695 a rotating gas-liquid separation plate 21 to separate the liquid refrigerant sucked together with the gas (see FIG. 1), but this also causes a problem that the liquid refrigerant can be easily merged into a refrigerant stream that increases the flow rate by rotation of the gas-liquid separation plate 21, to have low efficiency in gas-liquid separation.

In the compressor described in Japanese Patent Application Publication No. H09-236092, for the purpose of preventing a decrease in density due to overheating of the refrigerant sucked into the sealed housing, and further improving the efficiency of the motor, the liquid injection circuit injects the liquid refrigerant, condensed and liquefied by the condenser, over the motor for cooling. Although it aims to reduce the motor operating temperature to achieve high efficiency, it requires a separate liquid injection circuit for cooling the motor. This makes a configuration of the refrigeration cycle complex and further makes its control complex too, causing a problem of a higher cost. In addition, gas-liquid separation is difficult for the liquid refrigerant injected in the compressor and the gas refrigerant, especially in operating conditions where the number of rotations (rotation speed) of the compressor is high and the amount of refrigerant circulation is large, the liquid refrigerant is easily sucked into the compression mechanism, thus making gas-liquid separation difficult for the sucked refrigerant in the sealed housing. Furthermore, since the liquid refrigerant is not injected over a coil, which has the largest heating value, there is a problem that the motor is not cooled effectively.

The present invention has been made in view of the above, and an objective of the present invention is to provide a refrigerant compressor and a refrigeration cycle device that can prevent a decrease in refrigeration capacity by preventing a decrease in density of the refrigerant to be compressed, which is sucked into the sealed vessel, and improve the efficiency of the motor by lowering the temperature of the motor, and that are low-cost, highly reliable, and highly efficient.

Solution to Problems

In order to achieve the aforesaid objective, a refrigerant compressor reflecting one aspect of the present invention is characterized in that it includes: a sealed vessel; a compression mechanism that is housed in the sealed vessel and, after refrigerant is sucked into the sealed vessel, sucks the refrigerant in the sealed vessel for compression; a motor that is housed in the sealed vessel and drives the compression mechanism; a suction pipe for sucking the refrigerant into the sealed vessel; a cover that is arranged to face an outlet of the suction pipe, to force the refrigerant sucked through the suction pipe to collide against the cover for gas-liquid separation, and to allow liquid refrigerant outputted from the separation to drop on a coil of the motor; and a suction passage that introduces gas refrigerant outputted from the gas-liquid separation, for which the refrigerant sucked through the suction pipe is forced to collide against the cover, to an inlet of the compression chamber provided in the compression mechanism.

In addition, a refrigeration cycle device reflecting one aspect of the present invention is characterized in that it includes the refrigerant compressor as a refrigerant compressor for refrigeration or air conditioning.

Advantageous Effects of the Invention

According to the present invention, overheating of the refrigerant to be compressed can be prevented that is sucked into the sealed vessel, and a secure gas-liquid separation can be performed for the sucked refrigerant, to allow the liquid refrigerant to cool the coil which has the largest heating value in the motor, without a special change in the refrigeration cycle.

That is, a decrease in density of the refrigerant to be compressed can be prevented that is sucked into the sealed vessel, to prevent a decrease in refrigeration capacity, and the temperature of the motor can be lowered to improve motor efficiency, thus to provide a refrigerant compressor and a refrigeration cycle device that are low-cost, highly reliable and highly efficient.

EMBODIMENTS OF THE INVENTION

Next, embodiments of the present invention will be described in detail with reference to accompanying drawings.

First Embodiment

First, a description will be given of a first embodiment of the present invention with reference to FIGS. 1 and 2.

Figure 1:
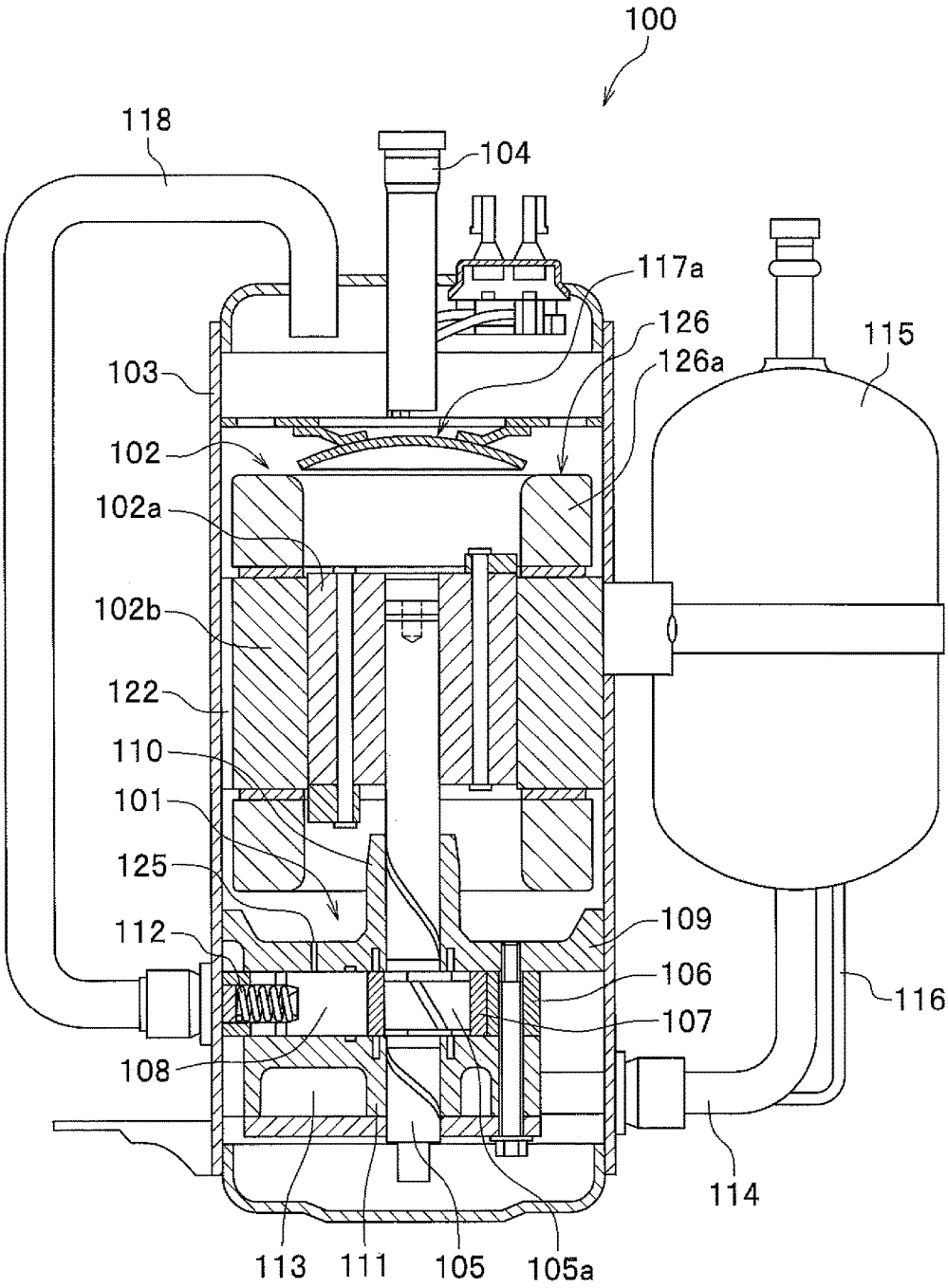
FIG. 1 is a longitudinal sectional view showing a rotary compressor according to a first embodiment of a refrigerant compressor of the present invention.

FIG. 1 is a longitudinal sectional view showing a rotary compressor 100 according to the first embodiment of the present invention.

In the first embodiment, for a refrigerant compressor of the present invention, a description will be given, by way of example, of a rotary compressor (rolling-piston compressor) of low-pressure chamber system 100 in which the inside of the sealed vessel serves as a space having a low temperature and a low pressure for sucking gas. In addition, a description will be given herein exemplary refrigerant compressor in which the compressor mechanism is arranged lower than the motor.

As shown in FIG. 1, the rotary compressor 100 is a refrigerant compressor that is used for refrigeration air conditioning in an air-conditioning system, such as an air conditioner, and a refrigeration system. The rotary compressor 100 has a sealed vessel 103 which forms a housing, and this is a refrigerant compressor of low-pressure chamber system in which the sealed vessel 103 is arranged to have a sucking pressure for the refrigerant to be introduced into the sealed vessel 103 through a suction pipe 104 provided at the top of the sealed vessel 103. A lower side of the sealed vessel 103 is arranged with the compression mechanism 101, and an upper side of the sealed vessel 103 is arranged with a motor 102 that gives rotation power to the compression mechanism 101. Here, the compression mechanism 101 and the motor 102 are hermetically housed in the sealed vessel 103.

The motor 102 has a rotor 102*a* and a stator 102*b*. The stator 102*b* is fixed to and supported by the inner wall surface of the sealed vessel 103. The rotor 102*a* is fixed to and supported by the shaft 105. Then, by energizing a coil 126 wound around a slot portion (not shown) of the stator 102*b*, rotation power is imparted to the rotor 102*a*.

The compression mechanism 101 has a cylinder 106, a roller 107, and a vane 108, and this is a rotary compression mechanism. The cylinder 106 is fixed to the underside of a frame 109 that is fixed to and supported by the inner wall surface of the sealed vessel 103. The roller 107 has a cylindrical shape, and is rotatably fitted to an eccentric portion 105*a* of the shaft 105 to rotate eccentrically in the cylinder 106. The shaft 105 is rotatably supported by an upper bearing 110 that is provided in the frame 109 and the lower bearing 111 that is fixed to the underside of the cylinder 106. Note that the eccentric portion 105*a* has an axis which is eccentric to the axis of the shaft 105 on a portion supported by the upper bearing 110 and the lower bearing 111.

The vane 108 is attached to the cylinder 106 so as to constantly have contact motion with the outer peripheral surface of the roller 107. The vane 108 is pressed against the outer peripheral surface of the roller 107 by a spring 112 at all times, to reciprocate within the cylinder 106 in accordance with the eccentric rotation motion of the roller 107. The vane 108 forms a compression chamber (not shown) in the cylinder 106.

The compression chamber communicates with a suction port (not shown) provided in the cylinder 106, and with a discharge chamber 113 formed in the lower portion of the lower bearing 111 through a discharge port (not shown) provided in the lower bearing 111. In addition, the discharge port is provided with a discharge valve (not shown). A discharge pipe 114 extends to the outside of the sealed vessel 103 from the discharge chamber 113, and communicates with an oil separator 115 provided next (laterally) to the rotary compressor 100. The refrigerant compressed by the compression mechanism 101 is discharged into the refrigeration cycle (not shown) via the oil separator 115.

A cover 117*a* is provided above the motor 102. The cover 117*a* exhibits a circular shape in planar view, having a diameter larger than the outer diameter of the rotor 102*a* and comparable to the diameter of the slot portion around which a coil 126 of the stator 102*b* is wound, and exhibits a three-dimensional shape of being convex upward and forming a part of the spherical surface (shape of substantially hemispherical shell). The cover 117*a* is provided to face the outlet of the suction pipe 104, and positioned so that the refrigerant to be compressed sucked into the sealed vessel 103 collides against the upper surface of the cover 117*a* for gas-liquid separation and the liquid refrigerant outputted from the separation drops on the coil 126.

Figure 2:
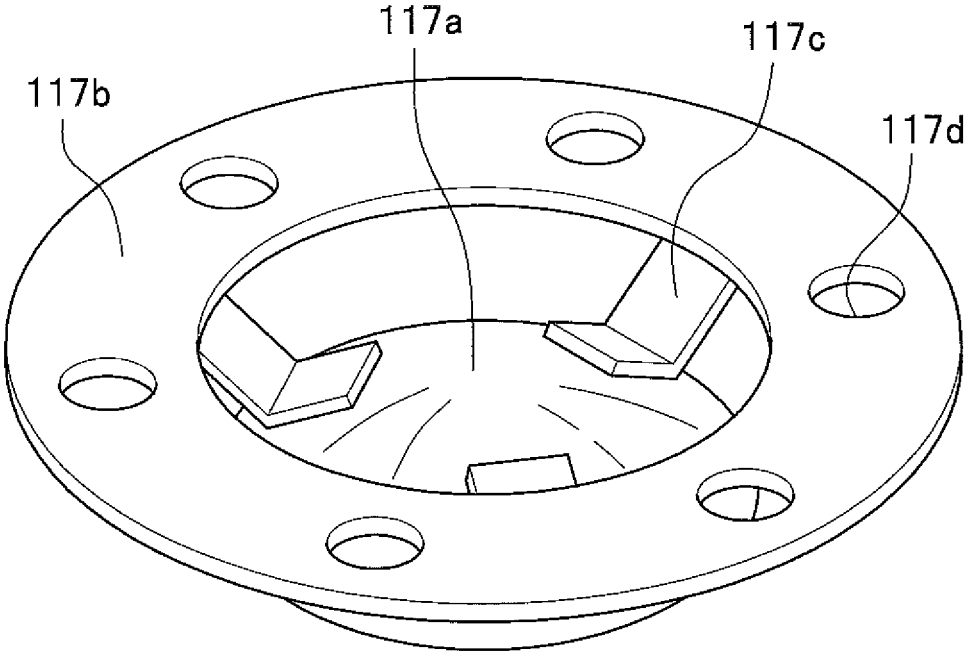
FIG. 2 is a perspective view of a cover and a support structure shown in FIG. 1.

FIG. 2 is a perspective view of the cover 117*a* and the support structure shown in FIG. 1. As shown in FIG. 2, the cover 117*a* is fixed to a support plate 117*b* in a ring shape that is fixed to and supported by the inner wall surface of the sealed vessel. 103 (see FIG. 1), by welding, screwing or the like via support legs 117*c*. The support plate 117*b* is provided with a plurality of gas holes 117*d* for improving ventilation of the gas refrigerant.

Referring back to FIG. 1, the rotary compressor 100 further includes a suction passage 118. The suction passage 118 communicates at one end with the top space in the sealed vessel 103 above the cover 117*a*, passes through the outside of the sealed vessel 103, and at the other end connects to and communicates with a suction port (not shown) provided in the cylinder 106.

Next, a description will be given of the operation of the first embodiment configured as above.

In the rotary compressor 100 according to the first embodiment, the refrigerant returned from the refrigeration cycle in a mixture of gas and liquid is introduced into the sealed vessel. 103 through the suction pipe 104. The refrigerant introduced into the sealed vessel 103 collides against the cover 117*a* immediately after flowing out of the outlet of the suction pipe 104. The liquid refrigerant, having a larger density in the refrigerant collided against the cover 117*a*, flows outward along the upper surface of the cover 117*a* in the shape of substantially hemispherical shell and then flows downward from the outer peripheral edge to drop on an upper coil potion 126*a*, which is located in the upper portion of the rotor 102*a*, of the coil 126 wound around the slot portion of the stator 102*b*.

Accordingly, the coil 126 of the stator 102*b* is cooled by the liquid refrigerant dropped from the outer peripheral edge of the cover 117*a*. Further, the liquid refrigerant flows through a gap between the outer periphery of the rotor 102*a* and the inner periphery of the stator 102*b*, and a refrigerant passage 122 provided between the outer periphery of the stator 102*b* and the inner wall surface of the sealed vessel 103, to a lower space located below the stator 102*b*. At this time, the liquid refrigerant cools surfaces of the rotor 102*a* and the stator 102*b*, and accumulates in a space located in the upper portion of the frame 109.

The heating value of the motor 102 is determined by the loss of each part that constitutes the motor 102, and the largest loss is a loss at the coil 126 (so-called copper loss) determined mainly by the electrical resistance of the conductor during energization. Thus, by constructing the cover 117*a* so that the liquid refrigerant of the refrigerant sucked through the suction pipe 104 drops on the coil 126 of the stator 102*b*, the liquid refrigerant can be used to actively cool the coil 126 of the stator 102*b* that generates the largest heating value. This allows the motor 102 to be cooled effectively.

Incidentally, the space located in the upper portion of the frame 109 is accumulated with sucked refrigerant and additionally small amount of lubricant circulating through the refrigeration cycle. Thus, an oil return passage 125 is provided in the frame 109, to return lubricant from the space located in the upper portion of the frame 109 through the oil return passage 125 to the suction port (not shown) provided in the cylinder 106.

On the other hand, the gas refrigerant, having lower density in the refrigerant collided against the cover 117*a*, stays in the top space located above the stator 102*b*, to be sucked into the inlet of the suction passage 118 arranged above the cover 117*a*. The gas refrigerant sucked into the inlet of the suction passage 118 flows through the suction passage 118 into the compression mechanism 101. Therefore, the gas refrigerant to be compressed is supplied to the compression mechanism 101 without receiving thermal influences from the motor 102, that is, while minimizing the increase in the temperature of the gas refrigerant.

The refrigerant through the suction passage 118 flows through a suction port (not shown) to a compression chamber (not shown) that is formed in the compression mechanism 101 between the inner surface of the cylinder 106 and the outer surface of the roller 107, and partitioned by the vane 108. The refrigerant flowed into the compression chamber is compressed by the roller 107 which is eccentrically rotated by rotation of the shaft 105, until a predetermined discharge pressure, and then a discharge valve (not shown) is opened to flow the refrigerant into the discharge chamber 113. The refrigerant flowed into the discharge chamber 113 flows into the oil separator 115 through the discharge pipe 114. In the oil separator 115, the lubricant flowing out of the compression chamber together with the refrigerant is separated and recovered, and the refrigerant is discharged to the refrigeration cycle. Incidentally, the recovered lubricant is returned into the sealed vessel 103 through the oil return pipe 116.

As described above, the rotary compressor 100 according to the first embodiment of the present invention includes: the sealed vessel 103; the compression mechanism 101 that is housed in the sealed vessel 103 and sucks refrigerant sucked into the sealed vessel 103 for compression; the motor 102 that is housed in the sealed vessel 103 and drives the compression mechanism 101; the suction pipe 104 for sucking the refrigerant into the sealed vessel 103; the cover 117*a* that is arranged to face the outlet of the suction pipe 104, to force the refrigerant sucked through the suction pipe 104 to collide against the cover for gas-liquid separation, and to allow liquid refrigerant outputted from the separation to drop on the coil 126 of the motor 102; and the suction passage 118 that introduces gas refrigerant outputted from the gas-liquid separation, for which the refrigerant sucked through the suction pipe 104 is forced to collide against the cover 117*a*, to the inlet of the compression chamber provided in the compression mechanism 101.

In the first embodiment, in the rotary compressor 100 where the inside of the sealed vessel 103 serves as a space having a low temperature and a low pressure for sucking gas, and the compression mechanism 101 is arranged lower than the motor 102, the sucked refrigerant, which is returned to the refrigerant compressor in a mixture of gas and liquid, is separated into gas and liquid in a sealed vessel 103, to prevent a decrease in reliability caused by the suction of the liquid refrigerant into the compression mechanism 101. The gas refrigerant separated is guided to the compression mechanism 101 in a state in which overheating by the motor 102 is minimized, and the liquid refrigerant separated is used for cooling the coil 126 of the stator 102*b* in the motor 102.

Therefore, according to the first embodiment, overheating of the refrigerant to be compressed can be prevented that is sucked into the sealed vessel 103, and a secure gas-liquid separation can be performed for the sucked refrigerant, to cool the coil 126, which has the largest heating value in the motor 102, with the liquid refrigerant, without conducting a special change in the refrigeration cycle.

That is, a rotary compressor 100 can be provided as a refrigerant compressor that can prevent a decrease in refrigeration capacity by preventing a decrease in density of the refrigerant to be compressed, which is sucked into the sealed vessel 103, and improve the efficiency of the motor 102 by lowering the temperature of the motor 102, and that is low-cost, highly reliable, and highly efficient.

In the first embodiment described above, the description has been given of the rotary compressor 100 as an example, and a similar configuration is also possible for a scroll compressor in which a compressor mechanism is arranged lower than a motor, to apply the present invention.

Second Embodiment

Next, a description will be given of a second embodiment of the present invention with reference to FIG. 3.

Figure 3:
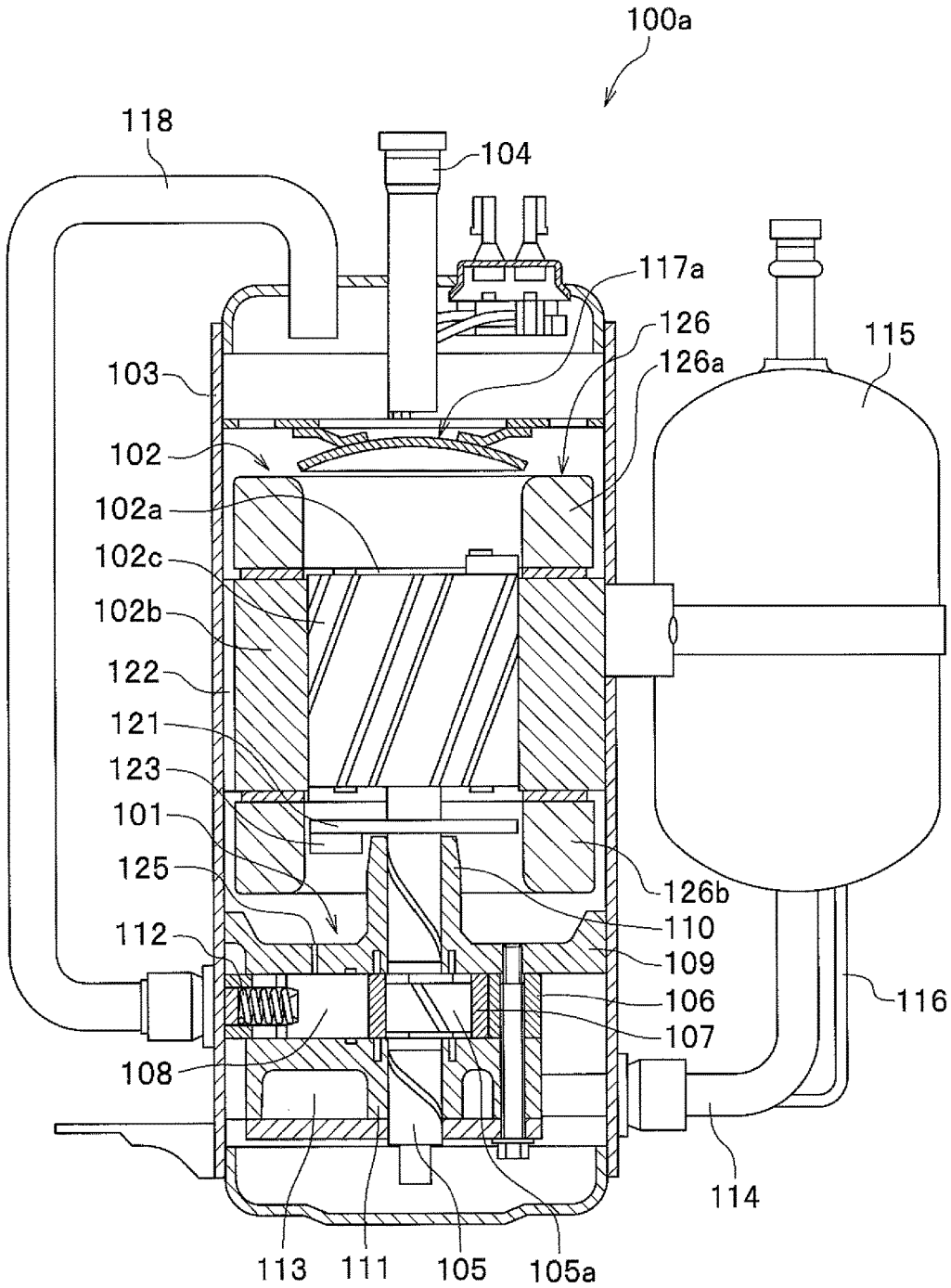
FIG. 3 is a longitudinal sectional view showing a rotary compressor according to a second embodiment of the present invention.

FIG. 3 is a longitudinal sectional view showing a rotary compressor 100*a* according to the second embodiment of the present invention. In the second embodiment, an example of the refrigerant, compressor will be described that can cool not only the upper coil portion 126*a* of the stator 102*b* but also the lower coil portion 126*b* of the stator 102*b*.

In the second embodiment, as in the first embodiment, a description will be given, by way of example, of a rotary compressor 100*a* of low-pressure chamber system. For components in the configuration of the second embodiment, having the same function as the rotary compressor 100 according to the first embodiment shown in FIG. 1, the same reference numerals are attached as those of the first embodiment, and a description thereof will be omitted as appropriate. The main difference from the rotary compressor 100 according to the first embodiment is that a motor 102 referred to as a skew motor is used in which skew grooves (grooves) 102*c* are formed on the outer peripheral surface of the rotor 102*a*, and a disk (plate member) 121 is arranged below the rotor 102*a*.

As shown in FIG. 3, the skew grooves 102*c* are formed on the outer peripheral surface of the rotor 102*a*, each groove being twisted from top down in the direction opposite to the rotation direction of the rotor 102*a* and continuously running from top to bottom of the rotor 102*a*. Here, the rotor 102*a* is rotated counterclockwise as viewed from above. Such a motor 102, having the rotor 102*a* formed with the skew grooves 102*c*, is used to reduce torque fluctuation, thus obtaining effects that vibrations and/or noises of the motor 102 are reduced.

In addition, the disk 121 is provided below the rotor 102*a*. The disk 121 is fixed to the shaft 105 and arranged at the same height as a part of the lower coil. 126*b*, which is located below the rotor 102*a*, of the coil 126 wound around the slot portion of the stator 102*b*. Further, a balance weight 123 is integrally attached to the under side of the disk 121 for canceling the eccentric weight of the shaft 105.

Next, a description will be given of an operation of the second embodiment configured as above.

In the rotary compressor 100*a* according to the second embodiment, the liquid refrigerant, which has cooled the upper coil portion 126*a* of the stator 102*b*, accumulates on the top of the stator 102*b* in the top space located at the top of the stator 102*b*, and the liquid refrigerant can be guided downward below the rotor 102*a* via the skew grooves 102*c* formed on the outer peripheral surface of the rotor 102*a*. At this time, the liquid refrigerant can cool the outer peripheral surface of the rotor 102*a* and the inner peripheral surface of the stator 102*b*.

Further, the liquid refrigerant, which is guided downward below the rotor 102*a*, drops on the disk 121 to be splashed onto the lower coil 126*b* of the stator 102*b* by a centrifugal force received on the rotating disk 121. Thus, the lower coil 126*b* of the stator 102*b* can be cooled with the liquid refrigerant, causing the motor 102 to be cooled more effectively.

Here, the liquid refrigerant accumulated on the stator 102*b* can be proactively transferred below the rotor 102*a* due to the viscosity pump effect by the skew grooves 102*c* of the rotor 102*a*. Thus, the coolant passage 122 (see FIG. 1) can be omitted that is provided in the first embodiment between the outer periphery of the stator 102*b* and the inner wall surface of the sealed vessel 103. Therefore, magnetic domains can be formed effectively in the steel sheet constituting the stator 102*b*, promising an improvement in the efficiency of the motor 102.

The rotary compressor 100*a* according to the second embodiment allows one to obtain the same operation effects as those in the first embodiment described above, and additionally to cool the coil 126 of the stator 102*b*, which has a large heating value in the motor 102, efficiently both at upper and lower portions of the stator 102*b*. This allows one to further lower the operating temperature of the motor 102 and to provide a refrigerant compressor with higher efficiency.

In addition, reducing vibrations and/or noises can be achieved by using skew motor formed with the skew grooves 102*c* on the outer peripheral surface of the rotor 102*a*. However, if vibrations and/or noises are not problematic primarily, or if the skew motor formed with continuous skew grooves cannot be adopted due to manufacturing reasons of the rotor, a pseudo skew motor may be used that has stepped grooves (each groove having portions that discontinuously vary in a direction perpendicular to the axis of the rotor, but running from top to bottom of the rotor 102*a*) on the outer peripheral surface of the rotor. Alternatively, oblique grooves may be formed in an ordinary motor on the outer peripheral surface of the rotor. Note that in this case the magnets are mounted on the rotor in parallel to the axial direction of the rotor. Even when using a pseudo skew motor or forming oblique grooves on the outer peripheral surface of the rotor of the normal motor as described above, similar effects can be obtained in cooling the motor, to allow one to provide a highly efficient refrigerant compressor.

Note that in the second embodiment described above, a description has been given, by way of example, of the rotary compressor 100*a* as in the first embodiment, but a similar configuration may be also possible for a scroll compressor in which a compression mechanism is arranged lower than the motor, to apply the present invention.

Third Embodiment

Next, a description will be given of a third embodiment of the present invention with reference to FIG. 4.

Figure 4:
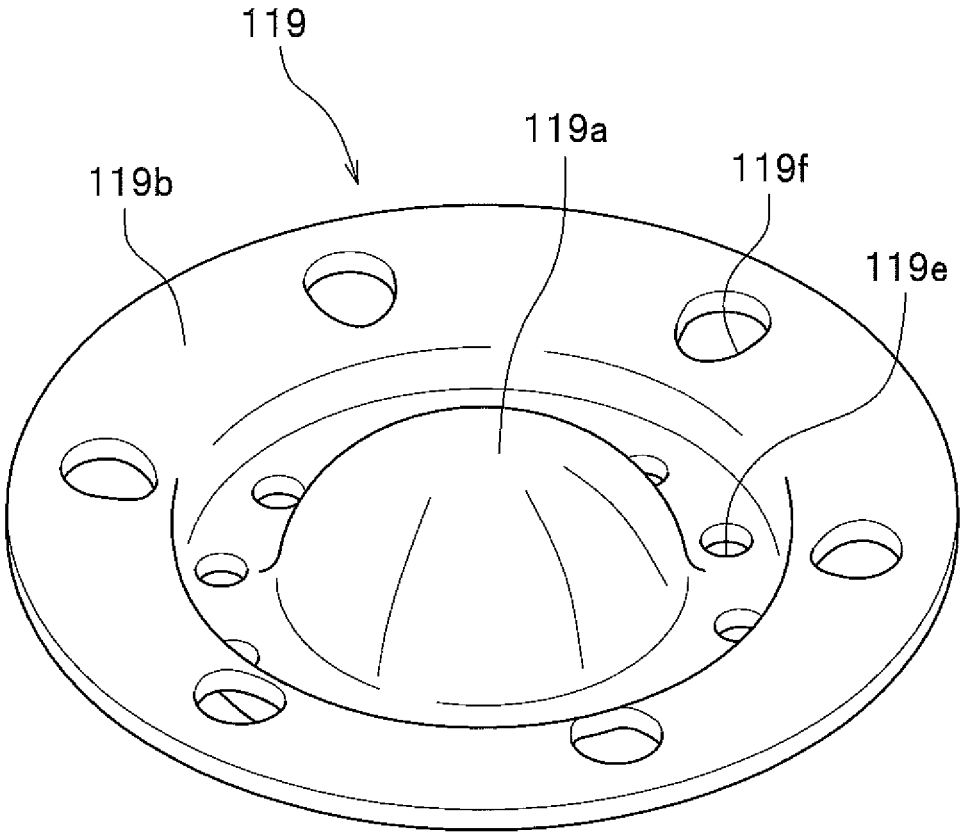
FIG. 4 is a perspective view of a cover of a rotary compressor according to a third embodiment of the present invention.

FIG. 4 is a perspective view of the cover 119 in the rotary compressor according to a third embodiment of the present invention. In the third embodiment, a description will be given of an exemplary refrigerant compressor that can perform gas-liquid separation of the sucked refrigerant at a lower cost.

In the third embodiment, a cover structure 119 shown in FIG. 4 is used instead of the cover 117*a* and its support structure in the rotary compressors 100, 100*a* according to the first and second embodiments, respectively, as described above. The same reference numerals are used for the same constituents as the above embodiments, and a duplicate descriptions will be omitted.

As shown in FIG. 4, the cover structure 119 includes a cover 119*a* in a shape of a substantially hemispherical shell, and a support plate (support member) 119*b* in a ring shape that is integrally formed with the cover 119*a* and fixed to and supported by the inner wall surface of the sealed vessel 103 (see FIG. 1). That is, the cover 119*a* is integrally formed from a single plate material, together with the support plate 119*b* for fixing and supporting the cover 119*a*. A plurality of liquid draining holes 119*e* are formed on the outer peripheral side of the cover 119*a* for dropping the liquid refrigerant after separation, and additionally a plurality of gas holes 119*f* are formed on the further outer peripheral side for improving ventilation of the gas refrigerant.

Therefore, according to the third embodiment, in addition to allowing one to obtain the same operation effects as those in the above embodiments, since the aforesaid cover 119*a* can be press-formed from a single sheet of plate material, together with the support plate 119*b* for fixing and supporting the cover 119*a*, the gas-liquid separation can be performed with a lower cost configuration.

Fourth Embodiment

Next, a description will be given of a fourth embodiment of the present invention with reference to FIG. 5.

Figure 5:
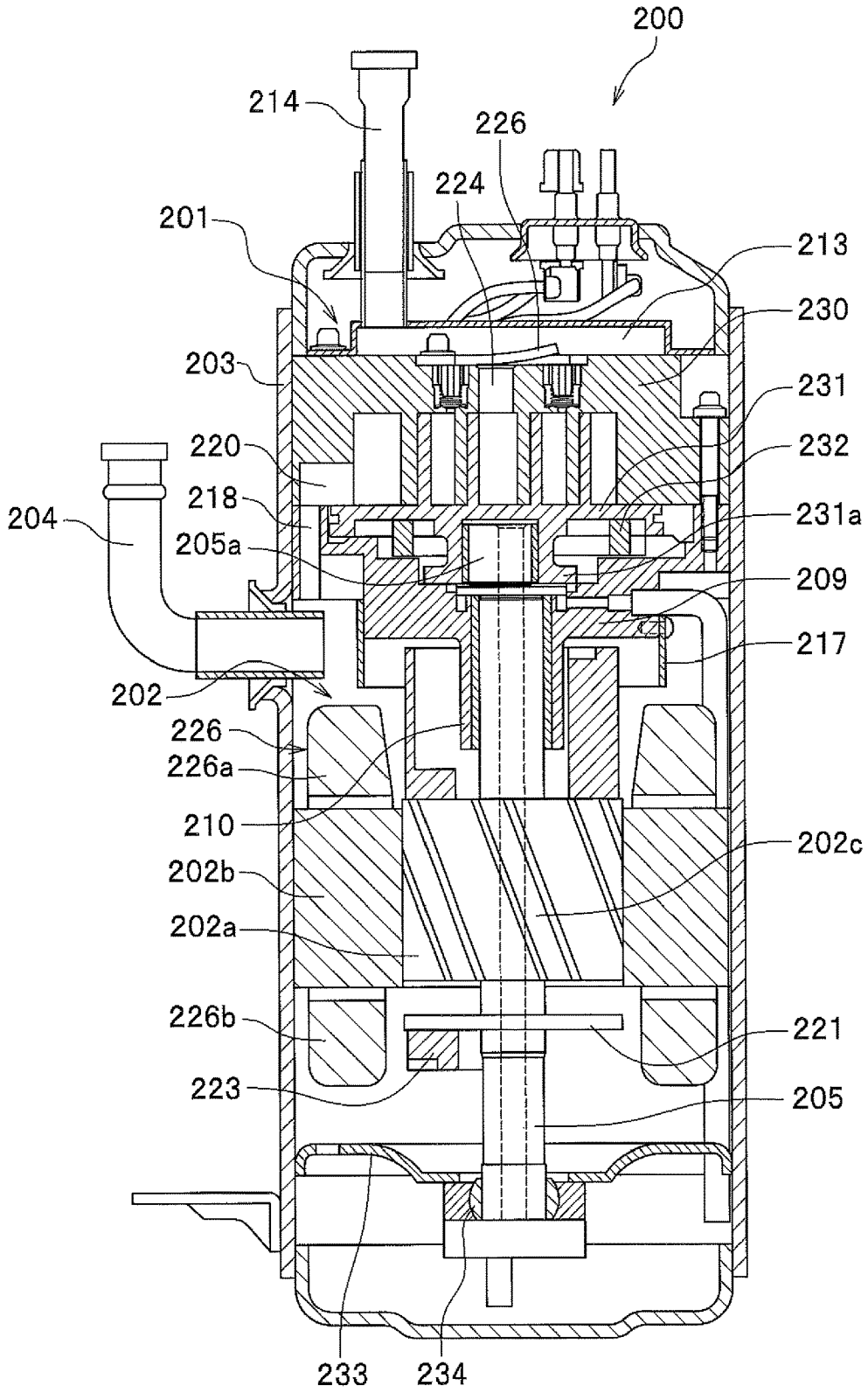
FIG. 5 is a longitudinal sectional view showing a scroll compressor according to a fourth embodiment of the present invention.

FIG. 5 is a longitudinal sectional view showing a scroll compressor 200 according to a fourth embodiment of the present invention.

In the fourth embodiment, a description will be given of a refrigerant compressor of the present invention, by way of example, of a scroll compressor 200 of low-pressure chamber system in which the inside of the sealed vessel serves as a space having a low temperature and a low pressure for sucking gas. In addition, a description will be given herein of an example of the refrigerant compressor in which a compressor mechanism is arranged higher than a motor.

As shown in FIG. 5, the scroll compressor 200 is a refrigerant compressor used for refrigeration air conditioning in an air-conditioning system, such as an air conditioner, and a refrigeration system. This scroll compressor 200 includes a sealed vessel 203 that forms an enclosure, and the sealed vessel 203 is provided with a suction pipe 204 for sucking refrigerant into the sealed vessel 203 and a discharge pipe 214 for discharging compressed refrigerant. On the upper side of the sealed vessel 203, a scroll compression mechanism 201 is arranged that includes a fixed scroll 230 and an orbiting scroll 231 which is meshed with the fixed scroll 230 to orbit. The fixed scroll 230 and the orbiting scroll 231 have tooth-shaped portions in spirals, respectively. In addition, on the lower side of the sealed vessel 203, a motor 202 is arranged that includes a rotor 202*a* and a stator 202*b*. Here, the compression mechanism 201 and the motor 202 are housed in a sealed vessel 203 in a sealed state.

An orbiting scroll bearing 231*a* provided on the back surface (under surface) of the orbiting scroll 231 is inserted with an eccentric portion 205*a* of a shaft 205 which is supported by a main bearing 210 provided in a frame 209. Then, an Oldham-coupling-ring 232 is arranged between the orbiting scroll. 231 and the frame 209 to constrain the rotation movement of the orbiting scroll 231 during rotation of the shaft 205, and to allow the orbiting scroll 231 to orbit.

The suction pipe 204 is designed for introducing refrigerant gas, and communicates with the sealed vessel 203. The inner space of the sealed vessel 203 communicates with a compression chamber that is formed by the fixed scroll 230 and the orbiting scroll 231 through a suction passage 218. The discharge pipe 214 is designed for discharging compressed refrigerant gas to the outside, and communicates with a discharge chamber 213 arranged on top of the fixed scroll 230.

Arranged below the motor 202 is a bearing support plate 233. An auxiliary bearing 234 provided on the bearing support plate 233 rotatably supports the shaft 205, together with the main bearing 210 provided in the frame 209.

Provided above the motor 202 is a cover 217. This cover 217 is, for example, in a cylindrical, shape having a diameter larger than the outer diameter of the rotor 202*a* and comparable to the diameter of a slot portion (not shown) around which a coil 226 of the stator 202*b* is wound. The cover 217 is provided facing the outlet of the suction pipe 204, and arranged at a position where sucked refrigerant to be compressed, which is sucked into the sealed vessel 203, collides against the side surface of the cover 217 in a cylindrical shape, to allow the liquid refrigerant outputted from the gas-liquid separation to drop on the coil 226. This cover 217 is fixed to the frame 209, for example, by screwing, or the like.

The suction passage 218 is formed inside the frame 209, communicating at one end with the upper portion of the sealed vessel 203 higher than the cover 217, and, at the other end, connected to and communicating with the suction port 220 in the fixed scroll 230. Thus, for a refrigerant compressor configured with the compression mechanism 201 at a higher position and the motor 202 at a lower position, the suction pipe 204 can be provided between the compression mechanism 201 and the motor 202, to make the distance closer between the suction pipe 204 and the suction port 220. This allows the distance of the suction passage 218 to become shorter, making the refrigerant passing through the suction passage 218 less likely to be affected by the heat, then the suction passage 218 can be formed inside the sealed vessel 203. However, if it is difficult to form a suction passage in the sealed vessel. 203 due to space problems, a suction passage may be provided so as to pass through the outside of the sealed vessel 203 as in the first and second embodiments described above.

Here, used as the motor 202 is a skew motor having skew grooves (grooves) 202*c* formed on the outer peripheral surface of the rotor 202*a*. The outer peripheral surface of the rotor 202*a* is formed with skew grooves 202*c* that are twisted from top down in the direction opposite to the rotation direction of the rotor 202*a*, continuously running from top to bottom of the rotor 202*a*. Here, the rotor 202*a* is rotated clockwise when viewed from above.

In addition, a disk 221 is provided below the rotor 202*a*. The disk 221 is fixed to the shaft 205 and arranged at the same height as a part of the lower coil 226*b*, which is located in the lower part of the rotor 202*a*, of the coil 226 wound around a slot portion of the stator 202*b*. Further, a balance weight 223 for canceling the eccentric weight of the shaft 205 is integrally attached to the underside of the disk 221.

Next, a description will be given of the operation of the fourth embodiment configured as above.

In the scroll compressor 200 according to the fourth embodiment, the refrigerant returned from the refrigerating cycle in a mixture of gas and liquid is introduced into the sealed vessel 203 through the suction pipe 204. Immediately after flowing out of the outlet of the suction pipe 204, the refrigerant introduced into the sealed vessel 203 collides against the cover 217 in a cylindrical shape. The liquid refrigerant, having larger density in the refrigerant collided against the cover 217, flows downward from the cover 217 after colliding against the cover 217, then drops on the upper coil portion 226*a*, which is located in the upper portion of the rotor 202*a*, of the coil 226 wound around the slot portion of the stator 202*b*.

Therefore, the coil 226 of the stator 202*b* is cooled by the liquid refrigerant dropped from the cover 217. Then, the liquid refrigerant is guided below the rotor 202*a* due to the viscosity pump effect by the skew grooves 202*c* of the rotor 202*a*, while cooling the outer peripheral surface of the rotor 202*a* and the inner peripheral surface of the stator 202*b*. The liquid refrigerant introduced below the rotor 202*a* drops on the disk 221 to be splashed onto the lower coil 226*b* of the stator 202*b* by a centrifugal force received on the rotating disk 221. Thus, the lower coil 226*b* of the stator 202*b* can be cooled with the liquid refrigerant, causing the coil 226 of the stator 202*b*, having the largest heating value in the motor 202, to be cooled effectively from both upper and lower sides.

On the other hand, the gas refrigerant, having a lower density in the refrigerant collided against the cover 217, stays in the top space located above the stator 202*b*, after colliding against the cover 217, to be sucked into the inlet of the suction passage 218 arranged above the cover 217. The gas refrigerant sucked into the inlet of the suction passage 218 flows through the suction passage 218 into the suction port 220 which is provided in the fixed scroll 230. Therefore, the gas refrigerant to be compressed is supplied to the compression mechanism 201 without receiving thermal influences from the motor 202, that is, while minimizing an increase in the temperature of the gas refrigerant.

Once the motor 202 is driven to rotate the rotor 202*a* and the shaft 205, the orbiting scroll 231 in the compression mechanism 201 initiates orbiting accordingly. This operation causes the orbiting scroll 231 and the fixed scroll 230 to mesh with each other at the respective tooth-shaped portions in spirals, forming the compression chamber.

At this time, the gas refrigerant flowed through the suction port 220 is compressed in the compression chamber. With the rotation of the shaft 205, the gas refrigerant is compressed while decreasing volume as moving toward the center of the orbiting scroll 231 and the fixed scroll 230. Accordingly, when the pressurized refrigerant gas is compressed to a predetermined discharge pressure, a discharge valve 226 is opened to flow the refrigerant into the discharge chamber 213 through a discharge port 224 formed in the fixed scroll 230. The refrigerant discharged into the discharge chamber 213 on the fixed scroll 230 is eventually discharged through the discharge pipe 214 to the outside of the scroll compressor 200.

As described above, in this fourth embodiment, in the scroll compressor 200 where the inside of the sealed vessel 203 serves as a space having a low temperature and a low pressure for sucking gas, and the compression mechanism 201 is arranged lower than the motor 202, the sucked refrigerant, which is returned to the refrigerant compressor in a mixture of gas and liquid, is separated into gas and liquid in the sealed vessel 203, to prevent a decrease in reliability caused by the suction of the liquid refrigerant into the compression mechanism section 201. The gas refrigerant separated is guided to the compression mechanism 201 in a state in which overheating by the motor 202 is minimized, and the liquid refrigerant separated is used for cooling the coil 226 of the stator 202*b* in the motor 202 from both upper and lower sides.

Therefore, according to the fourth embodiment, overheating of the refrigerant to be compressed can be prevented that is sucked into the sealed vessel 203, and a secure gas-liquid separation can be performed for the sucked refrigerant, to cool the coil 226, which has the largest heating value in the motor 202, with the liquid refrigerant from both upper and lower sides, without making a special change in the refrigeration cycle.

That is, a scroll compressor 200 can be provided as a refrigerant compressor that can prevent a decrease in refrigeration capacity by preventing a decrease in density of the refrigerant to be compressed, which is sucked into the sealed vessel 203, and improve the efficiency of the motor 202 by lowering the temperature of the motor 202 and that is low-cost, highly reliable, and highly efficient.

In addition, reducing vibrations and/or noises can be achieved by using a skew motor formed with the skew grooves 202*c* on the outer peripheral surface of the rotor 202*a*. However, if vibrations and/or noises are not problematic primarily, or if the skew motor formed with continuous skew grooves cannot be adopted due to manufacturing reasons of the rotor, a pseudo skew motor may be used that has stepped grooves on the outer peripheral surface of the rotor, or oblique grooves may be formed in an ordinary motor on the outer peripheral surface of the rotor. Even when configured as described above, similar effects can be obtained cooling the motor, to allow one to provide a highly efficient refrigerant compressor.

Further, when the temperature of the motor is not raised so high, an ordinary motor without oblique grooves on the outer peripheral surface may be used to adopt a structure in which only the upper coil portion of the stator is cooled with liquid refrigerant. In this case, it is desirable to provide a refrigerant passage between the outer periphery of the stator 202*b* and the inner wall surface of the sealed vessel 203 for the lubricant and the liquid refrigerant to drop.

Note that in the fourth embodiment described above, a description has been given, by way of example, of the scroll compressor 200, but a similar configuration may be also possible for a rotary compressor in which a compression mechanism is arranged higher than a motor, to apply the present invention.

The present invention has been described hereinabove based on the embodiments, but the present invention is not limited to the above embodiments and includes various modifications thereof. For example, the above embodiments have been described in detail in order to better illustrate the present invention and are not intended to necessarily limit to those including all the configurations described herein. In addition, a part of the configuration of an embodiment can be replaced with the configuration of another embodiment, and the configuration of an embodiment can be added with the configuration of another embodiment. Further, a part of the configuration of each of the embodiments can be deleted, added or replaced with other configurations.

For example, in the above embodiments, a description has been given of examples in which the present invention is applied to a scroll compressor and a rotary compressor, but the present invention is not limited thereto. The present invention is applicable to any refrigerant compressor of low-pressure chamber system having a compression mechanism which, after refrigerant is sucked into a sealed vessel, sucks the refrigerant into the sealed vessel to compress, even to other types of refrigerant compressors.

In addition, in the above embodiments, a description has been given by way of example of the cover 117*a*, 119*a* in a shape of substantially hemispherical shell, and the cover 217 in a cylindrical shape, but the present invention is not limited thereto. The present invention allows a cover in other shape, such as a substantially conical shape, to be used as long as it can force refrigerant sucked through a suction pipe to collide against the cover for gas-liquid separation to allow the liquid refrigerant outputted from the separation to drop onto a coil of a motor.

Further, the present invention may be used to configure a refrigeration cycle device including a refrigerant compressor according to the present invention as a refrigerant compressor for refrigeration air conditioning. This refrigeration cycle device includes: a refrigerant compressor according to the present invention; a condenser for radiating heat from refrigerant gas which is compressed by the refrigerant compressor so as to be at a high temperature and a high pressure; a decompressor for decompressing the high-pressure refrigerant from the condenser; and an evaporator for evaporating the liquid refrigerant from the decompressor. Such a refrigeration cycle device may be used in a refrigeration system, air conditioning system, a heat pump water heater, or the like.

The invention claimed is:

1. A refrigerant compressor comprising:

a sealed vessel;

a compression mechanism that is housed in the sealed vessel and, after refrigerant is sucked into the sealed vessel, sucks the refrigerant in the sealed vessel for compression;

a motor that is housed in the sealed vessel and drives the compression mechanism;

a suction pipe for sucking the refrigerant into the sealed vessel;

a cover that is arranged to face an outlet of the suction pipe, to force the refrigerant sucked through the suction pipe to collide against the cover for gas-liquid separation, and to allow liquid refrigerant to drop on a coil of the motor; and a suction passage that, after the refrigerant sucked through the suction pipe is forced to collide against the cover for the gas-liquid separation, introduces gas refrigerant to an inlet of the compression chamber provided in the compression mechanism, wherein the motor has a stator that is fixed inside the sealed vessel, and a rotor that rotates, grooves are formed on an outer peripheral of the rotor, each groove being twisted from top down in a direction opposite to a rotation direction of the rotor, and the refrigerant compressor includes: a shaft that fixes and supports the rotor; and a rotating disk that: i) extends perpendicularly to a longitudinal direction of the refrigerant compressor, ii) is arranged within a lower coil portion, below the rotor, iii) extends radially outward from the shaft a distance that is the same as a distance that the rotor extends radially outward from the shaft, so that the liquid refrigerant, which is guided downward below the rotor, and which drops on the rotating disk is splashed onto the lower coil portion by a centrifugal force on the rotating disk, thereby cooling the lower coil portion, and iv) is fixed to the shaft.

2. The refrigerant compressor according to claim 1, wherein the compression mechanism is a scroll compression mechanism.

3. The refrigerant compressor according to claim 1, wherein the cover is integrally formed from a single plate material, together with a support member for fixing and supporting the cover.

4. A refrigeration cycle device comprising the refrigerant compressor according to claim 1, as a refrigerant compressor for refrigeration or air conditioning.

5. The refrigerant compressor according to claim 1, wherein the compression mechanism is a rotary compression mechanism.

* * * * *